US007905270B2

(12) United States Patent
Kawai

(10) Patent No.: US 7,905,270 B2
(45) Date of Patent: Mar. 15, 2011

(54) DEMOLDING METHOD AND EQUIPMENT

(75) Inventor: Nobuyuki Kawai, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 666 days.

(21) Appl. No.: 11/793,801

(22) PCT Filed: Dec. 15, 2005

(86) PCT No.: PCT/JP2005/023057

§ 371 (c)(1),
(2), (4) Date: Mar. 3, 2008

(87) PCT Pub. No.: WO2006/068029

PCT Pub. Date: Jun. 29, 2006

(65) Prior Publication Data

US 2009/0114361 A1 May 7, 2009

(30) Foreign Application Priority Data

Dec. 24, 2004 (JP) ..... 2004-373652

(51) Int. Cl.
*B22D 29/00* (2006.01)

(52) U.S. Cl. ..... 164/131; 164/344

(58) Field of Classification Search ..... 164/131, 164/344
See application file for complete search history.

(56) References Cited

U.S. PATENT DOCUMENTS 2,651,087 A * 9/1953 Fellows ..... 164/194

FOREIGN PATENT DOCUMENTS

| | | |
|---|---|---|
| JP | 59-1460 | 1/1984 |
| JP | 2-65471 | 5/1990 |
| JP | 11-5153 A | 1/1999 |
| JP | 2000-176632 A | 6/2000 |
| JP | 2001-25859 A | 1/2001 |
| JP | 2001-71123 A | 3/2001 |

* cited by examiner

*Primary Examiner* — Kevin P Kerns
(74) *Attorney, Agent, or Firm* — Finnegan, Henderson, Farabow, Garrett & Dunner, L.L.P.

(57) ABSTRACT

A demolding method and equipment to reduce dents produced in an as-cast product. The method includes the steps of placing a tight-flask cope on a tight-flask drag for mating, such that a gate for the tight-flask cope and drag faces upward; reversing the tight-flask cope and drag after they are poured with molten metal such that the gate faces downward; and drawing a cope, a drag, and an as-cast product from the reversed tight-flask cope and drag, with the gate facing downward, from above to below.

4 Claims, 12 Drawing Sheets

Fig. 12
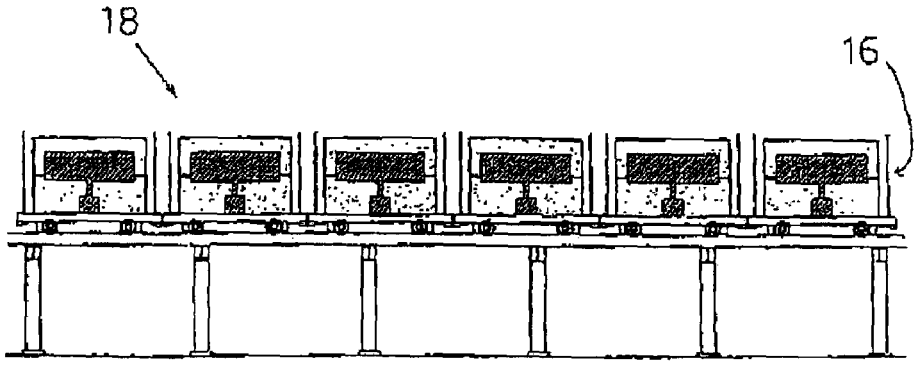
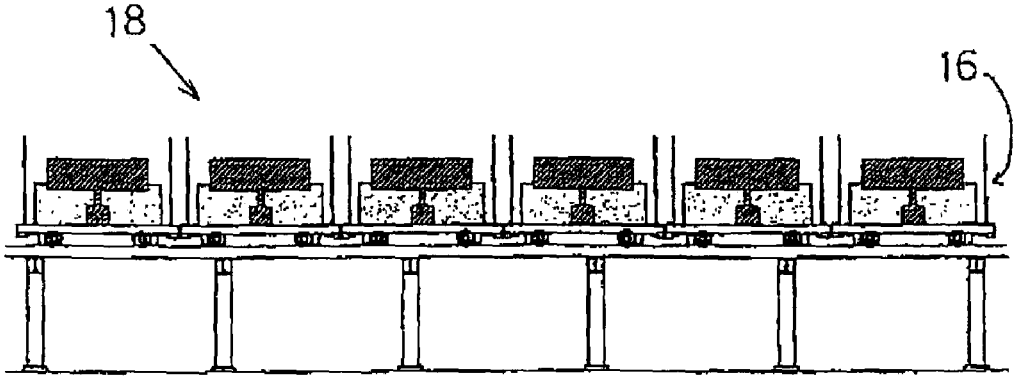
Fig. 13

DEMOLDING METHOD AND EQUIPMENT

TECHNICAL FIELD

This invention relates to a method and a equipment for demolding.

BACKGROUND ART

JPY 59(1984)-1460 discloses a demolding method. In that method a tight-flask cope is placed on a tight-flask drag and molten metal is poured through a gate formed in the cope. A mold-drawing head, which is disposed above the cope is then lowered to draw the cope, the drag, and an as-cast product from the tight flasks, from above to below. In this method the cope, drag, and the as-cast product fall, with the gate being located above and the as-cast product located below. Thus the as-cast product tends to be subjected to dents due to the impact caused by the falling.

The present invention has been conceived in view of that problem. It aims to provide a demolding method and a demolding equipment that can reduce the dents that may be formed in the as-cast product.

DISCLOSURE OF THE INVENTION

To the above end, a demolding method of the present invention includes the steps of placing a tight-flask cope on a tight-flask drag for mating, such that a gate for the tight-flask cope and drag faces upward, and of reversing the tight-flask cope and drag after the tight-flask cope and drag are poured with molten metal such that the gate faces downward; and drawing a cope, a drag, and an as-cast product from the reversed tight-flask cope and drag, with the gate facing downward, from above to below.

Another aspect of the demolding method of the present invention includes the steps of placing a tight-flask cope on a tight-flask drag for mating, such that a gate for the tight-flask cope and drag faces upward, and of reversing the tight-flask cope and drag after the tight-flask cope and drag are poured with molten metal such that the gate faces downward; separating only the tight-flask drag, which has been reversed and thus located above, from the tight-flask cope, which has been reversed and thus located below the tight-flask drag, allowing an as-cast product and the downwardly facing gate to remain in the tight-flask cope; and drawing a cope, a drag, and the as-cast product from the reversed tight-flask cope and drag, from above to below.

A further aspect of the demolding method of the present invention includes the steps of placing a tight-flask cope on a tight-flask drag for mating, such that a gate for the tight-flask cope and drag faces upward, and after the mated tight-flask cope and drag are poured with molten metal, transferring the mated tight-flask cope and drag placed on a lower level truck to a level-truck-mounting station; placing an upper level truck on the tight-flask cope and drag at the level-truck-mounting station such that the upper level truck faces the lower level truck; transferring the tight-flask cope and drag and the lower and upper level trucks from the level-truck-mounting station to a reversing station; reversing the tight-flask cope and drag and the upper and lower level trucks at the reversing station with the tight-flask cope and drag being sandwiched between the upper level truck and the lower level truck so that the upwardly facing gate faces downward; transferring the reversed tight-flask cope and drag and upper and lower level trucks from the reversing station to a level-truck-separating station; separating at the level-truck-separating station the lower level truck, which has been reversed and thus located above; returning the separated lower level truck to the level-truck-mounting station, and placing the returned lower level truck as an upper level truck on a tight-flask cope that is transferred together with a mated tight-flask drag to the level-truck-mounting station; separating the upper level truck from an assembly of the tight-flask cope and drag and the upper level truck, which assembly has been transferred from the level-truck-separating station; and drawing a cope, a drag, and an as-cast product with the gate facing downward, from the tight-flask cope and drag, from above to below.

A further aspect of the demolding method of the present invention includes the steps of placing a tight-flask cope on a tight-flask drag for mating, such that a gate for the tight-flask cope and drag faces upward, and after the mated tight-flask cope and drag are poured with molten metal, transferring the mated tight-flask cope and drag placed on a lower level truck to a level-truck-mounting station; placing an upper level truck on the tight-flask cope and drag at the level-truck-mounting station such that the upper level truck faces the lower level truck; transferring the tight-flask cope and drag and the lower and upper level trucks from the level-truck-mounting station to a reversing station; reversing the tight-flask cope and drag and the upper and lower level trucks at the reversing station with the tight-flask cope and drag being sandwiched between the upper level truck and the lower level truck so that the upwardly facing gate faces downward; transferring the reversed tight-flask cope and drag and upper and lower level trucks from the reversing station to a level-truck-separating station; separating at the level-truck-separating station the lower level truck, which has been reversed and thus located above; returning the separated lower level truck to the level-truck-mounting station, and placing the returned lower level truck as an upper level truck on a tight-flask cope that is transferred together with a mated tight-flask drag to the level-truck-mounting station; separating the upper level truck from an assembly of the tight-flask cope and drag and the upper level truck which assembly has been transferred from the level-truck-separating station; separating the tight-flask drag, which is located above, from the tight-flask cope, which has been reversed and thus located under the tight-flask drag, allowing an as-cast product to remain in the tight-flask cope; and drawing a cope and the as-cast product from the tight-flask cope holding the as-cast product, from above to below.

An aspect of the demolding equipment of the present invention includes a reversing means for reversing a tight-flask cope placed on a tight-flask drag for mating such that a gate for the tight-flask cope and drag faces upward, the mated tight-flask cope and drag being poured with molten metal, such that the gate faces downward; and a mold-drawing means for drawing a cope, a drag, and an as-cast product from the reversed tight-flask cope and drag, with the gate facing downward, from above to below.

A further aspect of the demolding equipment of the present invention includes a reversing means for reversing a tight-flask cope placed on a tight-flask drag for mating such that a gate for the tight-flask cope and drag faces upward, the mated tight-flask cope and drag being poured with molten metal, such that the gate faces downward; a tight-flask drag-separating means for separating only the tight-flask drag, which has been reversed and thus located above, from the tight-flask cope, which has been reversed and thus located below the tight-flask drag, allowing an as-cast product and the downwardly facing gate to remain in the tight-flask cope; and drawing a cope, a drag, and the as-cast product from the reversed tight-flask cope and drag, from above to below.

A further aspect of the demolding equipment of the present invention includes a level-truck-mounting means for placing an upper level truck on a opposing lower level truck on which mated tight-flask cope and drag are carried, with a gate for the tight-flask cope and drag facing upward, the mated tight-flask cope and drag being poured with molten metal and being transferred to a level-truck-mounting station; a reversing means for reversing at a reversing station disposed downstream the level-truck-mounting station the tight-flask cope and drag and the upper and lower level trucks, with the tight-flask cope and drag being sandwiched between the upper level truck and the lower level truck, such that the gate faces downward; a level-truck-separating means for separating at a level-truck-separating station disposed downstream the reversing station the lower level truck, which has been reversed and thus located on the tight-flask drag; a level-truck-transfer means for returning the separated lower level truck to the level-truck-mounting station; an upper-level-truck-separating means for separating the upper level truck from the tight-flask cope and the upper level truck, which has been transferred from the level-truck-separating station; and a mold-drawing means for drawing a cope, a drag, and an as-cast product from the tight-flask cope and drag, with the gate facing downward, from above to below.

A further aspect of the demolding equipment of the present invention includes a level-truck-mounting means for placing an upper level truck on a opposing lower level truck on which mated tight-flask cope and drag are carried, with a gate for the tight-flask cope and drag facing upward, the mated tight-flask cope and drag being poured with molten metal and being transferred to a level-truck-mounting station; a reversing means for reversing at a reversing station disposed downstream the level-truck-mounting station the tight-flask cope and drag and the upper and lower level trucks, with the tight-flask cope and drag being sandwiched between the upper level truck and the lower level truck, such that the gate faces downward; a level-truck-separating means for separating at a level-truck-separating station disposed downstream the reversing station the lower level truck, which has been reversed and thus located on the tight-flask drag; a level-truck-transfer means for returning the separated lower level truck to the level-truck-mounting station; an upper-level-truck-separating means for separating the upper level truck from the tight-flask cope and the upper level truck, which has been transferred from the level-truck-separating station; a tight-flask-drag separating means for separating only the tight-flask drag, which is located above, from the tight-flask cope located under the tight-flask drag, allowing an as-cast product to remain in the tight-flask cope; and a mold-drawing means for drawing a cope and the as-cast product from the tight-flask cope, from above to below.

BRIEF DESCRIPTION OF THE DRAWINGS

FIG. 12 is a side view of a first embodiment of the secondary cooling line.

FIG. 13 is a side view of a second embodiment of the secondary cooling line.

BEST MODE FOR CARRYING OUT THE INVENTION

Figure 1:
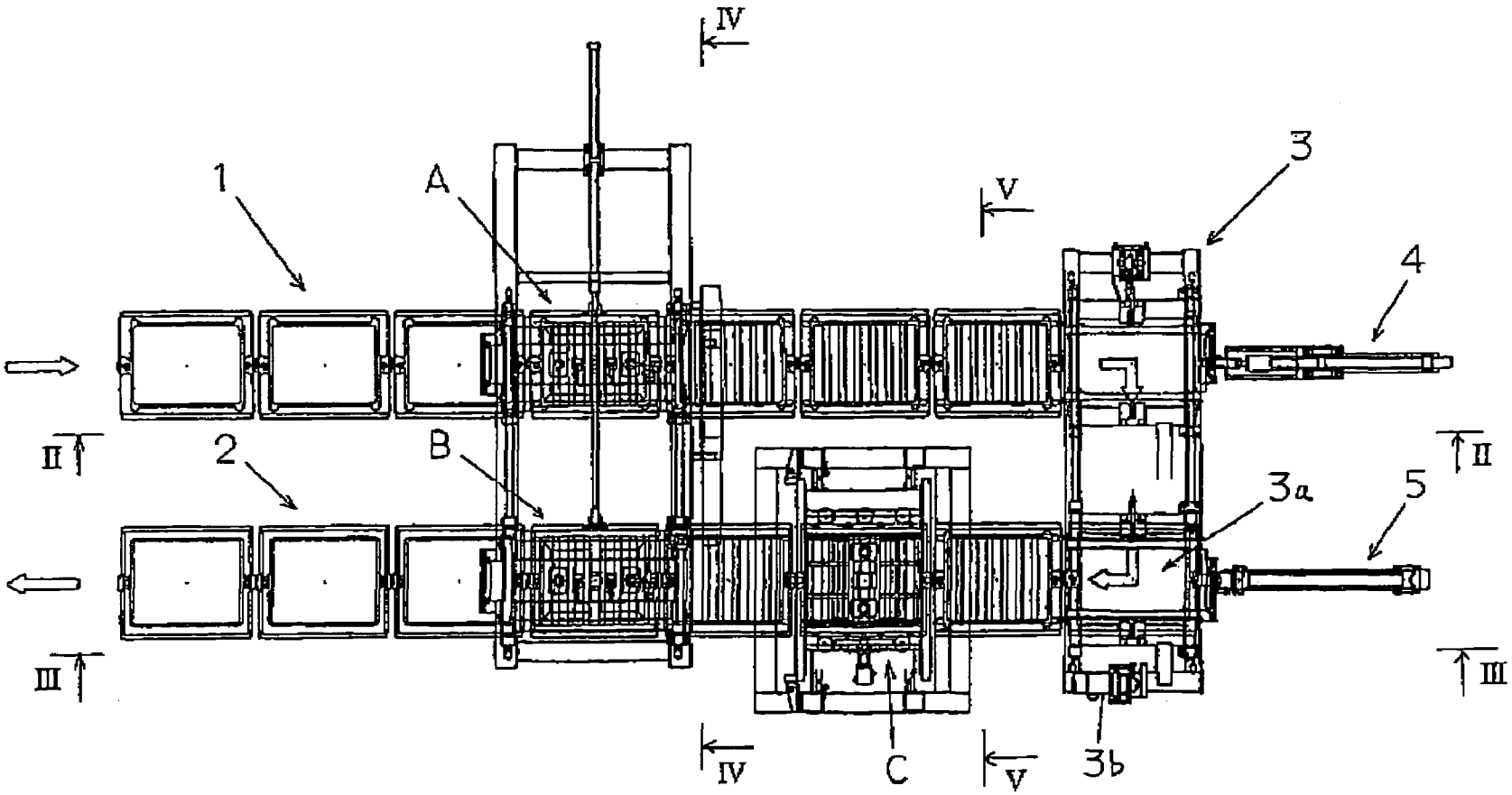
FIG. 1 is a plan view of the embodiment of the present invention.

The first embodiment of the present invention will be explained based on the drawings. In FIG. 1 a level-truck-mounting station A is disposed midway of a first transfer line 1, and a level-truck-separating station B is disposed midway of a second transfer line 2. Further, a mold-transfer device 3, which is provided with a transfer truck 3*a*, is disposed outside the terminal end of the first transfer line 1 and the starting end of the second transfer line 2. Further, at the outside of the mold-transfer device 3 a cushioning device 4 is disposed on the first transfer line 1, while a mold-feeding device 5 is disposed on the second transfer line 2. Further, a reversing station C is disposed on the second transfer line 2 between the level-truck-separating station B and the mold-transfer device 3.

Figure 2:
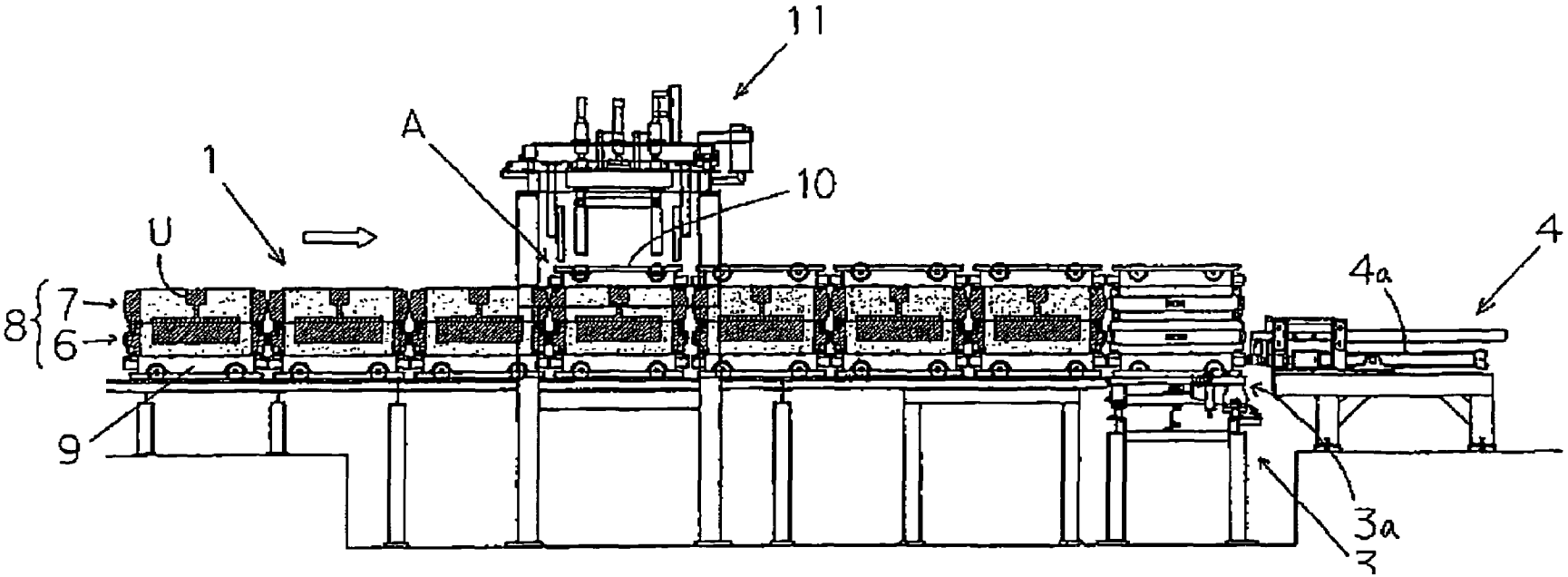
FIG. 2 is a view taken along the line of arrows II-II in FIG. 1.

The operation of the demolding equipment, which has the above-explained structure, will be explained below. In the second transfer line 2 shown in FIG. 2, by extending a cylinder of the mold-feeding device 5 (not shown in FIG. 2) when the rod of a cylinder 4*a* of the opposing cushioning device 4 is extended, and by retracting the cylinder 4*a* of the cushioning device 4, a group of successive tight-flask molds 8 (each mold 8 including a pair of tight-flask mold halves, i.e., a tight-flask cope 7 and a tight-flask drag 6, both are sand mold halves) are transferred ahead (in the direction shown by an while arrow in FIG. 2) by one pitch (i.e., by one flask). As shown in FIG. 2, the tight-flask cope 7 and the tight-flask drag 6 of the tight-flask mold 8 are mated each other so that the tight-flask cope 7 is placed on the tight-flask drag 6, with their gate U facing upward, and they have been poured with molten metal and are transferred on a lower level truck 9.

As the group of the tight-flask molds 8 is transferred ahead by one pitch, a tight-flask mold 8 placed on the lower level truck 9 is transferred to the level-truck-mounting station A. At the station A, an upper level truck 10 is placed on the tight-flask mold 8 so that it opposes the lower level truck 9. A level-truck-transfer device 11 puts the upper level truck 10 on the tight-flask mold 8. Below the level-truck-transfer device 11 will be explained.

Figure 4:
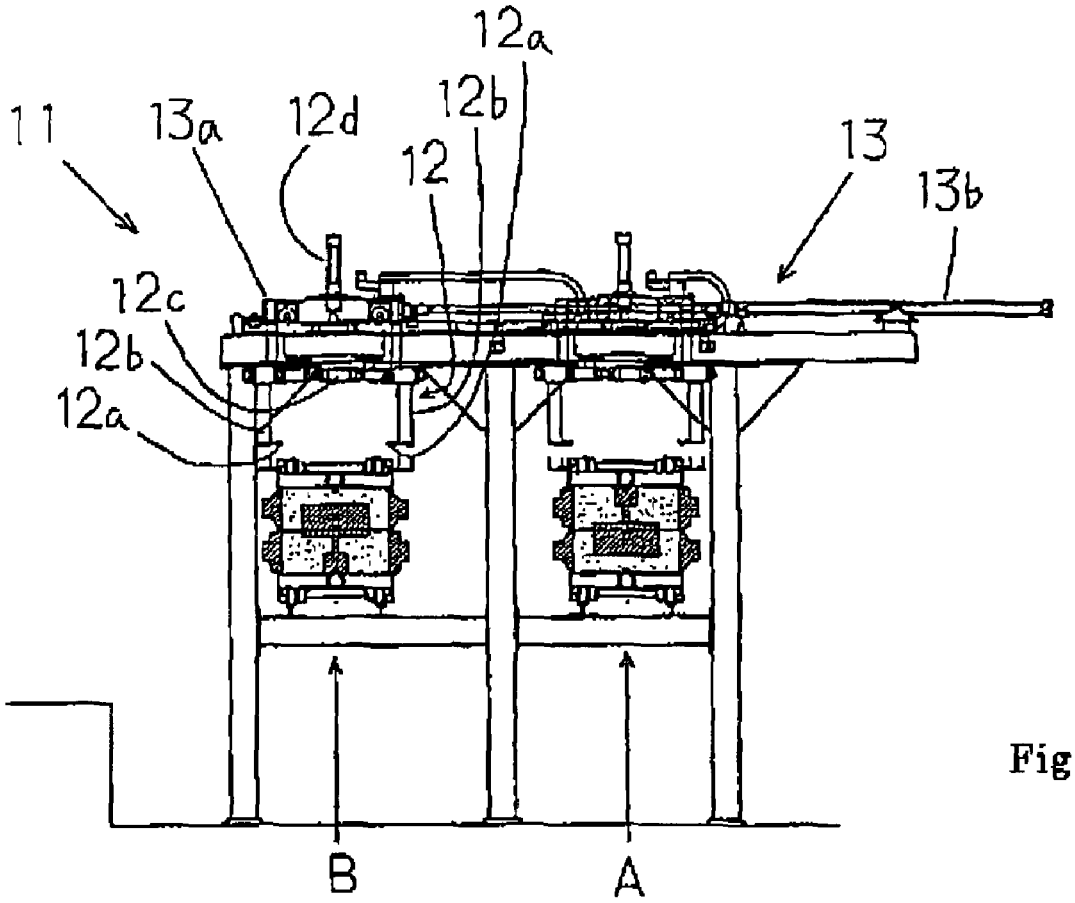
FIG. 4 is a view taken along the line of arrows IV-IV in FIG. 1.

As shown in FIG. 4, the level-truck-transfer device 11 has a level-truck-separating means 12, the means also acting as a level-truck-placing means. Further, the level-truck-transfer device 11 also has a level-truck-transfer means 13. First, the level-truck-separating means 12 is explained. In the level-truck-separating means 12, a pair of opposing arms 12*b*, 12*b* provided with nail members 12*a*, 12*a* at their end are opened or closed by an opening/closing cylinder 12*c*. The nail members 12*a*, 12*a*, the arms 12*b*, 12*b*, and the opening/closing cylinder 12*c* are integrally lifted by a lifting cylinder 12*d*. The level-truck-separating means 12 acts as said level-truck placing means at the level-truck-mounting station A.

Next the level-truck-transfer means 13 is explained. The lifting cylinder 12*d* of the level-truck-separating means 12 is mounted on a truck 13*a*, which is reciprocatingly moved between the level-truck-mounting station A and level-truck-separating station B by a truck-moving cylinder 13*b*.

The operation at the level-truck-mounting station A is now explained in detail. A lower level truck 9, which has been separated at the level-truck-separating station B, and a truck 13 wait at the level-truck-mounting station A. From this stage, the group of the tight-flask molds 8 are transferred ahead by one pitch, and hence a tight-flask mold 8 placed on the lower level truck 9 is transferred to the level-truck-mounting station A.

By extending the lifting cylinder 12*d*, the arms 12*b*, 12*b* are lowered. Accordingly, the waiting lower level truck 9 is placed on the tight-flask cope 7 of the tight-flask mold 8 as an "upper level truck 10". When the arms 12*b*, 12*b* reach their lower stop end, they are opened outward by extending the opening/closing cylinder 12*c*. From this stage, the lifting cylinder 12*d* is retracted, to integrally lift the nail members 12*a*, 12*a*, the arms 12*b*, 12*b*, and the opening/closing cylinder 12*c*. The truck-moving cylinder 13*b* is then extended, to transfer the truck 13*a* to the level-truck-separating station B.

As the group of the tight-flask molds 8 is then transferred ahead by one pitch, as explained above, the tight-flask mold 8, the lower level truck 9, and the upper level truck 10 of the level-truck-mounting station A are integrally transferred therefrom. Further, per the one pitch transfer of the group of the tight-flask molds 8, the tight-flask mold 8, the lower level truck 9, and the upper level buck 10 of the terminal end of the first transfer line 1 are put on the transfer truck 3*a*, which is waiting at the first transfer line 1 side. The transfer truck 3*a*, and the tight-flask mold 8, the lower level truck 9, and the upper level truck 10, which are placed on the transfer truck 3*a*, are moved to the second transfer line 2 side in the conventional manner by operating a motor 3*b* (see FIG. 1).

Further, as in the first transfer line 1, the group of the tight-flask molds 8 is transferred ahead by one pitch in the second transfer line 2. Namely, in the second transfer line 2 in FIG. 3, by extending a cylinder 5*a* of the mold-feeding device 5 when the cylinder rod of the opposing cushioning device (not shown in FIG. 3) is extended, and by retracting the cylinder rod of the opposing cushioning device, the group of successive tight-flask mold 8 are transferred ahead (in the direction of white arrow in FIG. 3) by one pitch (by one flask). Accordingly, the space above the transfer truck 3*a* will be vacant. The transfer truck 3*a* is then moved to the first transfer line 1 side by reversely operating the motor 3*b* (see FIG. 1).

Further, the group of the tight-flask molds 8 is transferred ahead by one pitch, the tight-flask mold 8, the lower level truck 9, and the upper level truck 10 are transferred to the reversing station C. They are reversed at the reversing station C, with the tight-flask molds 8 being sandwiched between the lower level truck 9 and the upper level truck 10, so that the gate U faces downward. The reversing is carried out by a mold-reversing device 14, which will be explained below.

Figure 3:
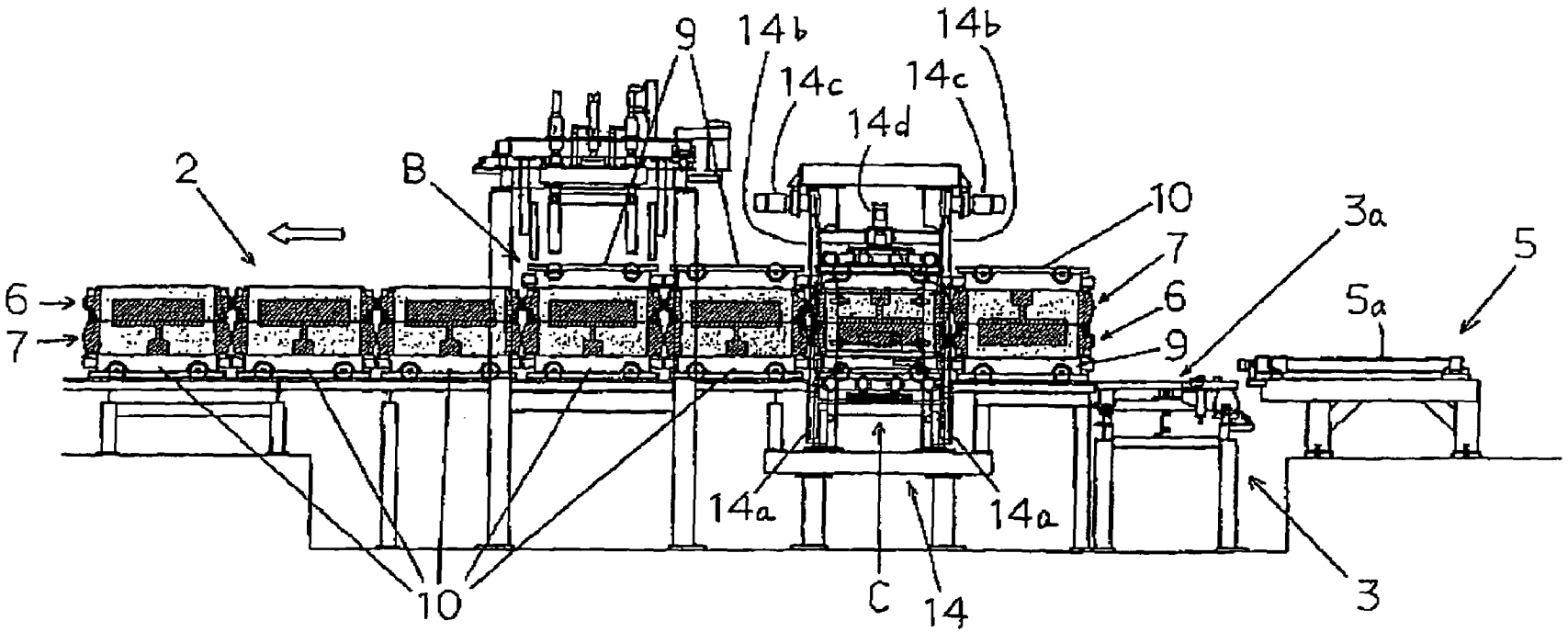
FIG. 3 is a view taken along the line of arrows III-III in FIG. 1.
Figure 5:
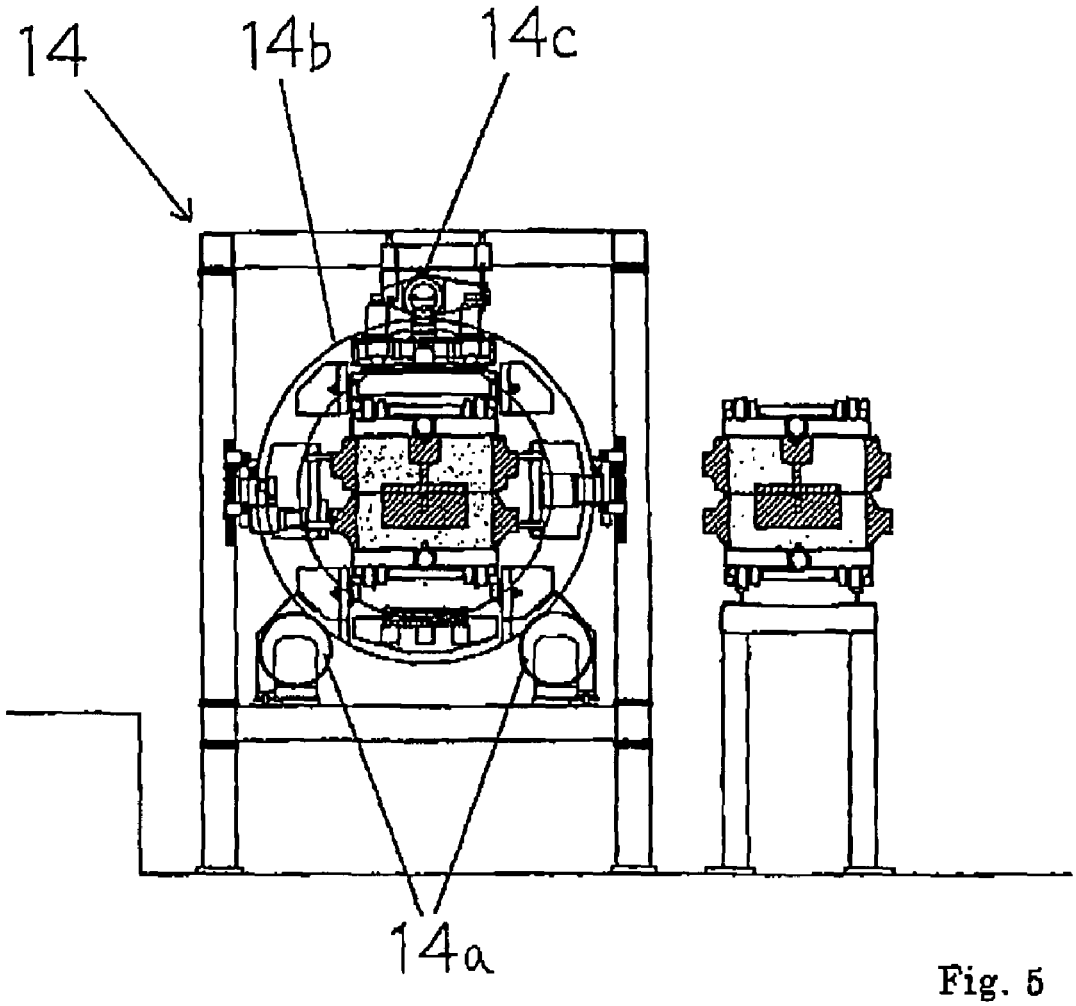
FIG. 5 is a view taken along the line of arrows V-V in FIG. 1.

In FIGS. 3 and 5, circular reversing bodies 14*b*, 14*b*, which are received by rotatable rollers 14*a*, 14*a*, are reversed by motors 14*c*, 14*c*. The tight-flask mold 8, the lower level truck 9, and the upper level truck 10 are transferred in between the reversing body 14*b* and 14*b* and are reversed together with the reversing bodies. Further, by extending a depressing cylinder 14*d*, the tight-flask mold 8 is kept sandwiched between the lower level truck 9 and the upper level truck 10. It is released from them when the depressing cylinder 14*d* is retracted.

Figure 6:
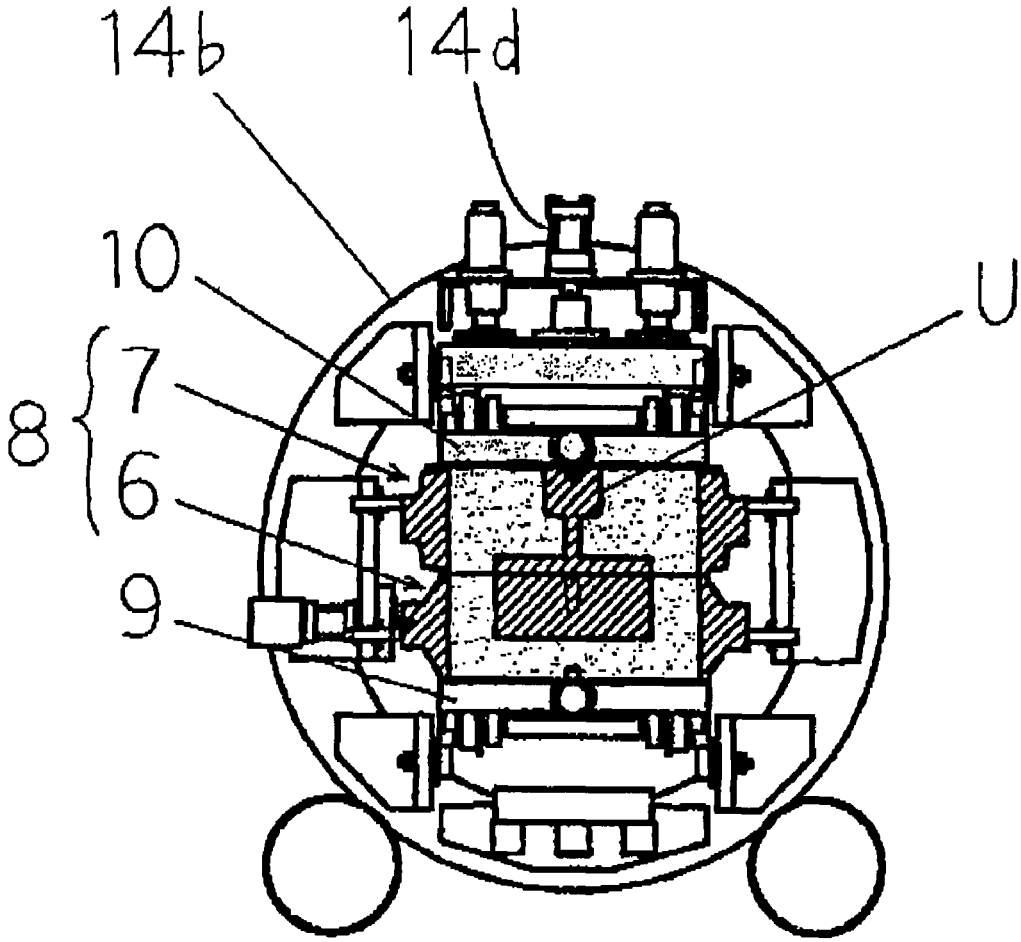
FIG. 6 is an expanded fragmentary view of FIG. 5 for explaining the operation of a reversing station, showing an upper level truck and a lower level truck, which are transferred into the station and are sandwiching a cope held in a flask and a drag held in a flask.

The operation at the reversing station C will be explained below in detail. As the group of the tight-flask molds 8 is transferred ahead by one pitch, the tight-flask mold 8 with its gate U facing upward, the lower level truck 9, and the upper level truck 10 are transferred in between the reversing body 14*b* and 14*b*. By extending the depressing cylinder 14*d*, the tight-flask mold 8 is then sandwiched between the lower level truck 9 and the upper level truck 10, as shown in FIG. 6.

Figure 7:
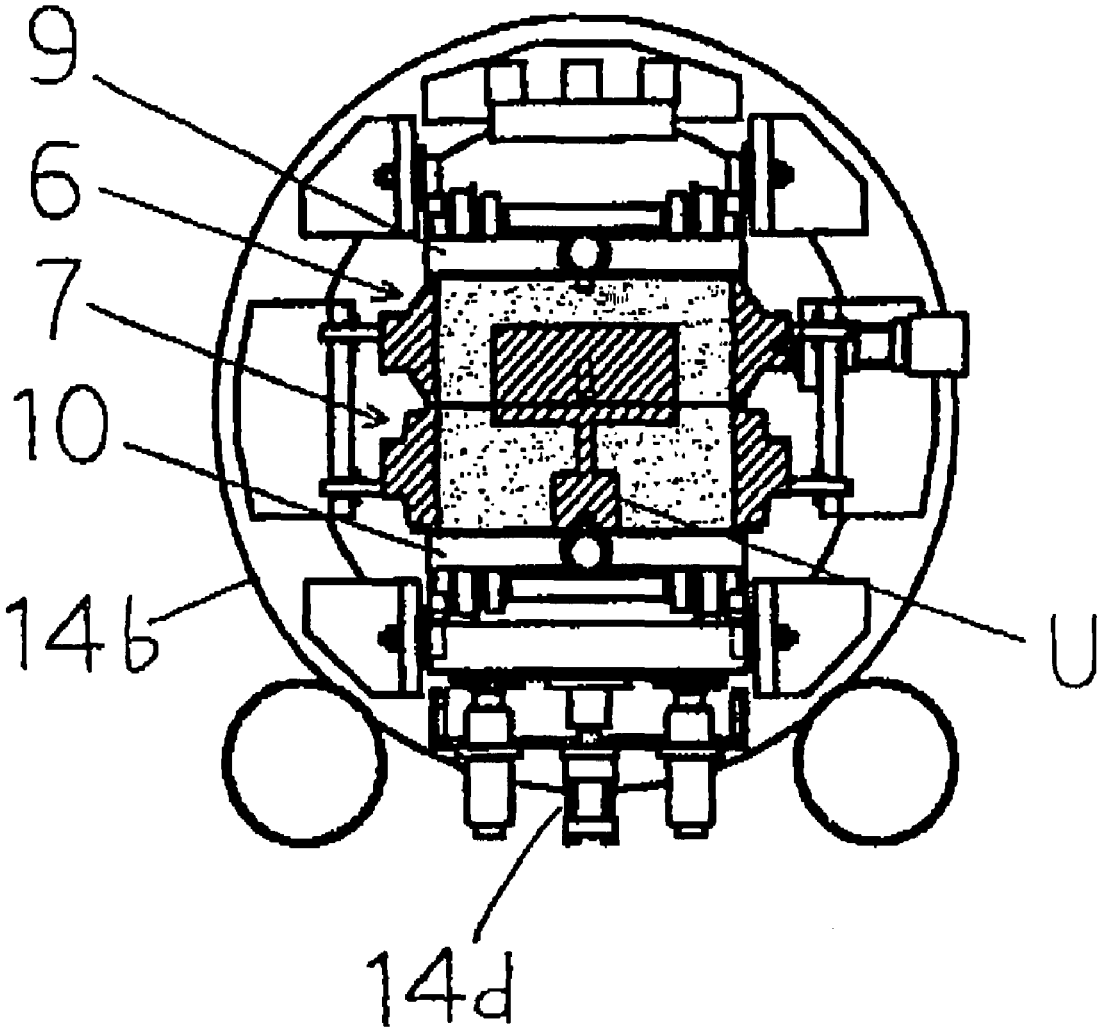
FIG. 7 is a cross-sectional side view, similar to FIG. 6, for explaining the operation of the reversing station, showing the upper and lower level trucks being rotated clockwise through 180° from the position shown in FIG. 6.

The motors 14*c*, 14*c* are then operated to rotate the tight-flask mold 8, the lower level truck 9, the upper level truck 10, and the reversing bodies 14*b*, 14*b* through 180° a clockwise (right turn). Accordingly, as in FIG. 7, from below to above the upper level truck 10, the tight-flask cope 7, the tight-flask drag 6, and the lower level truck 9, are superimposed on one another, with the gate U facing downward. The depressing cylinder 14*d* is then retracted to disengage the tight-flask mold 8 from the lower and upper level trucks 9, 10.

As the group of the tight-flask molds 8 is then transferred ahead by one pitch, the right-turned, tight-flask mold 8, lower level truck 9, and upper level truck 10, are transferred from the reversing bodies 14*b*, 14*b*, while the following set of a lower level truck 9, a tight-flask mold 8, and an upper level truck 10 is transferred in between the reversing body 14*b* and 14*b*. The tight-flask mold 8 is then sandwiched between the lower level truck 9 and the upper level truck 10 by extending the depressing cylinder 14*d*.

Figure 8:
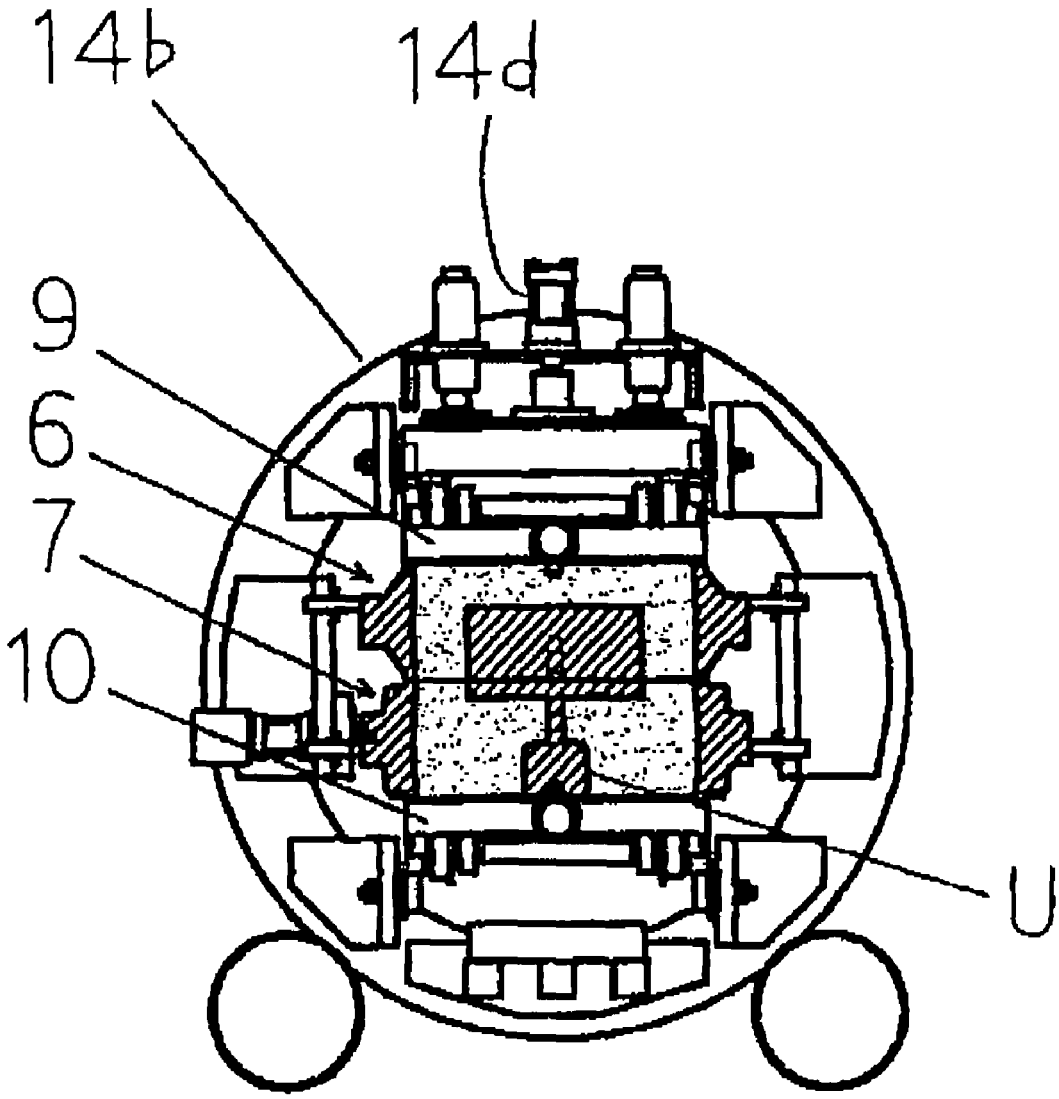
FIG. 8 is a cross-sectional side view, similar to FIG. 7, for explaining the operation of the reversing station, showing the upper and lower level trucks being rotated anticlockwise through 180°.

The motors 14*c*, 14*c* are then reversed, to rotate the lower level truck 9, the tight-flask mold 8, the upper level truck 10, and the reversing bodies 14*b*, 14*b* through 180° counterclockwise (left turn) (see FIG. 8). The same as in the right turn, from below to above, the upper level truck 10, the tight-flask cope 7, the tight-flask drag 6, and the lower level truck 9, are superimposed on one another, with the gate U facing downward. The depressing cylinder 14*d* is then retracted to disengage the tight-flask mold 8 from the lower and upper level trucks 9, 10. The group of the tight-flask molds 8 is then transferred ahead by one pitch. The above operation process will be repeated.

The tight-flask mold 8, the lower level truck 9, and the upper level truck 10, which have been reversed as explained above and have been transferred from the reversing station C, are transferred to the level-truck-separating station B as the group of the tight-flask molds 8 are transferred ahead by one pitch. At the level-truck-separating station B the lower level truck 9, which is now located on the tight-flask drag 6, is separated.

The operation at the level-truck-separating station B will be explained below in detail. As the group of the tight-flask molds 8 are transferred ahead by one pitch, the upper level truck 10, the tight-flask cope 7, the tight-flask drag 6, and the lower level truck 9, which are superimposed on one another from below to above, are transferred to the level-truck-separating station B. The lifting cylinder 12*d* mounted on the truck 13*a*, which truck has been moved from the level-truck-mounting station A to the level-truck-separating station B, is extended to allow the arms 12*b*, 12*b* to be lowered.

Figure 9:
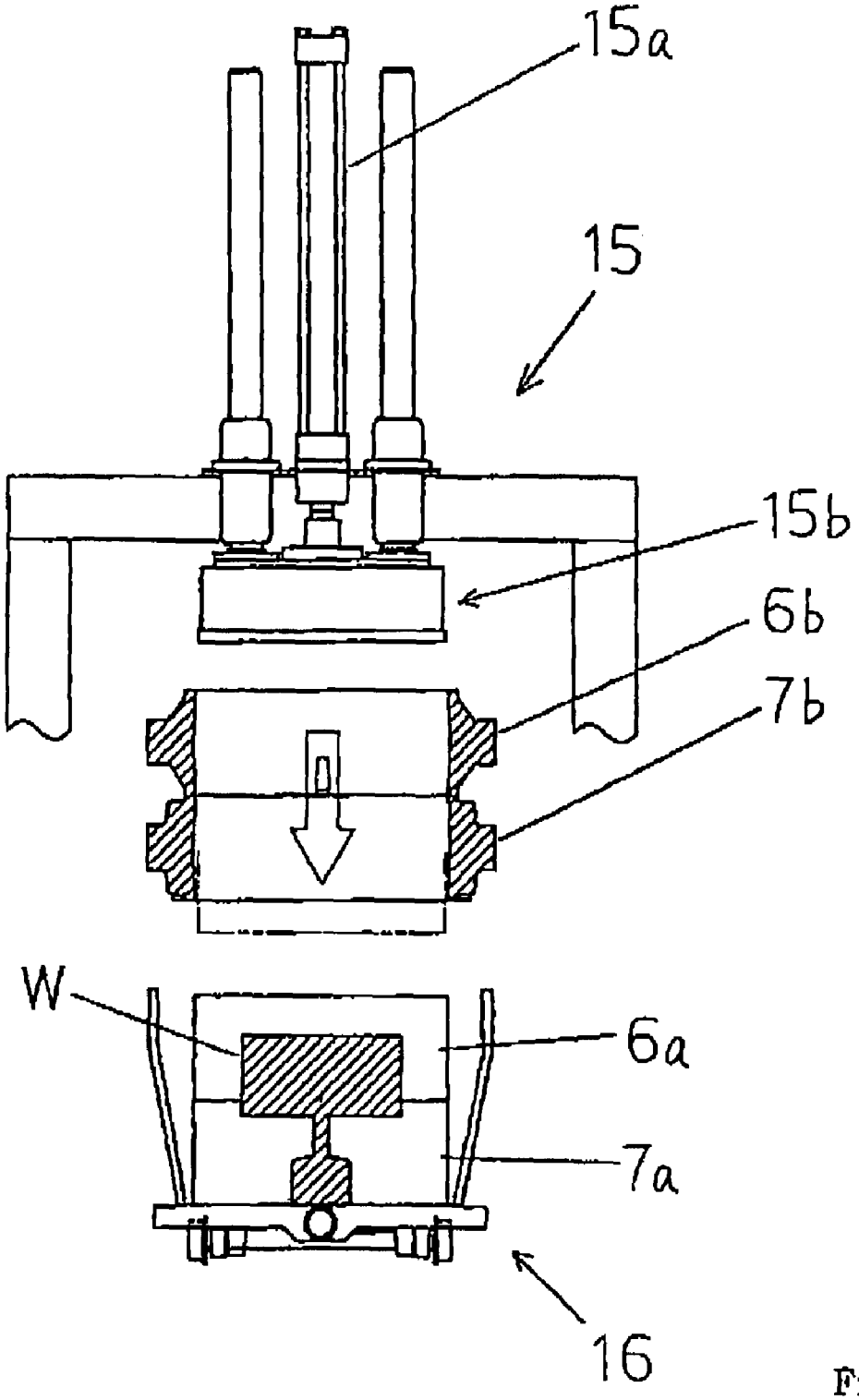
FIG. 9 is a cross-sectional side view of the fist embodiment that uses a mold-drawing means.

When the arms 12*b*, 12*b* reach their lower stop end, they are closed inward by retracting the opening/closing cylinder 12*c*. From this stage, the lifting cylinder 12*d* is retracted to catch and move the lower level truck 9 upward with the nail members 12*a*, 12*a*, to separate it. The separated lower level truck 9 is returned to the level-truck-mounting station A, together with the truck 13*a* by retracting the truck-moving cylinder 13*b*. The lower level truck 9 is placed as an "upper level truck 10" on a tight-flask cope 7 of a tight-flask mold 8 that is transferred to the level-truck-mounting station A. The tight-flask mold 8 and the upper level truck 10, which have been separated from the lower level truck 9, are transferred from the level-truck-separating station B as the group of the tight-flask molds 8 is transferred ahead by one pitch. The upper level truck 10 is then separated from the tight-flask mold 8 by an upper-level-truck-separating means (not shown) in a post-process in the second transfer line 2. Thus, the tight-flask mold 8 remains there, with its gate U facing downward. The separation of the upper level truck 10 from the tight-flask mold 8 may be performed by moving the tight-flask mold 8 upward using the same means as a tight-flask-drag separating means 17, which will be explained below, or by moving the upper level truck 10 downward, while the tight-flask mold 8 is supported by rollers or any other means. As shown in FIG. 9, the tight-flask mold 8 separated from the upper level truck 10 is transferred to a position just below a mold-drawing means 15 by a conventional device (not shown). In the mold-drawing means 15, by downwardly extending a drawing cylinder 15*a*, a cope 7*a*, a drag 6*a*, and an as-cast product W are downwardly drawn out of the tight flasks 7*b*, 6*b* by a drawing head 15*b*. A series of secondary cooling pallet-like trucks 16, each acting as a pallet for receiving and for secondary cooling the falling cope and drag, are transferred to the position below the mold-drawing means 15. The cope 7*a*, the drag 6*a*, and the as-cast product W are put in the secondary cooling pallet-like truck 16.

The series of secondary cooling pallet-like trucks 16, each carrying the cope 7*a*, the drag 6*a*, and the as-cast product W, are transferred ahead pitch by pitch in a second cooling line 18 in FIG. 12.

The empty flasks 7*b*, 6*b*, which are cleared of the cope 7*a* and drag 6*a*, are transferred for the following process (not shown) after the drawing head 15*b* reaches its upper stop end by retracting the drawing cylinder 15*a*.

Next, the second embodiment of the present invention will be explained. Some initial processes of the second embodiment are the same as those in the first embodiment, up to the process wherein the upper level truck 10 is separated from the tight-flask mold 8 by the upper-level-truck separating means (not shown) in the post-process in the second transfer line 2, and thus the tight-flask mold 8 remains, with the gate U facing upward.

Figure 10:
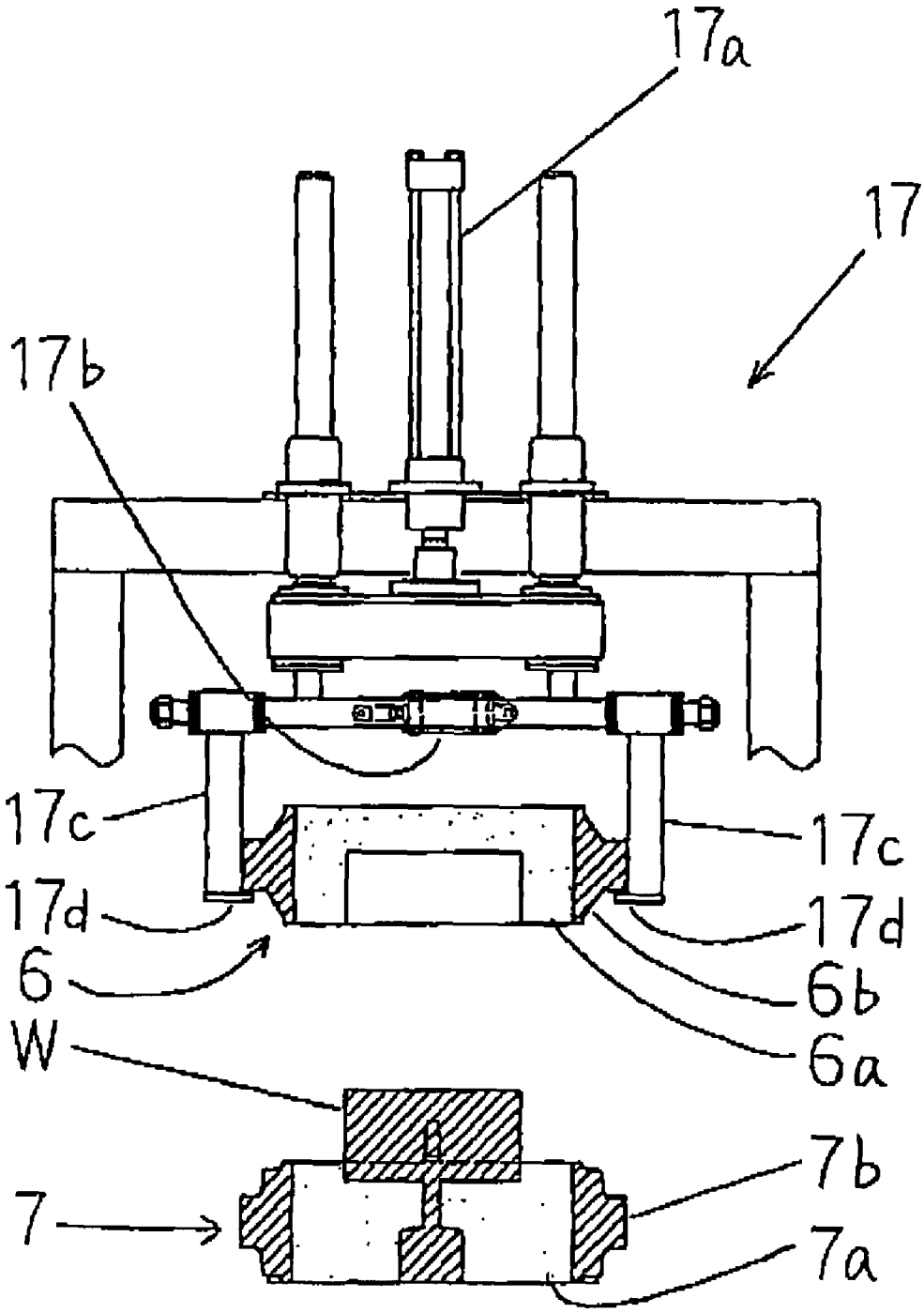
FIG. 10 is a cross-sectional side view of means for separating a tight-flask drag.

The remaining tight-flask mold 8 is then transferred by a transfer means (not shown) to a position just below a tight-flask-drag separating means 17 (FIG. 10). At the tight-flask-drag separating means 17, first, a lifting cylinder 17*a* is extended to its lower stop end, and an opening/closing cylinder 17*b* is then retracted to close arms 17*c*, 17*c*. From this stage, the lifting cylinder 17*a* is retracted to catch and move the tight-flask drag 6 upward by nail members 17*d*, 17*d* of the lifting cylinder 17*a*, as shown in FIG. 10. Accordingly, the tight-flask drag 6 is separated from the tight-flask cope 7 in which the as-cast product W remains, with the gate U facing downward. In this separation the tight-flask drag 6 may be separated upwardly as shown in FIG. 10. Alternatively, the tight-flask cope 7 holding the as-cast product W may be placed on a liftable table (not shown), and the table is then lowered, while the tight-flask drag 6 is supported, to separate the tight-flask cope 7 and the as-cast product W downward from the tight-flask drag 6.

Figure 11:
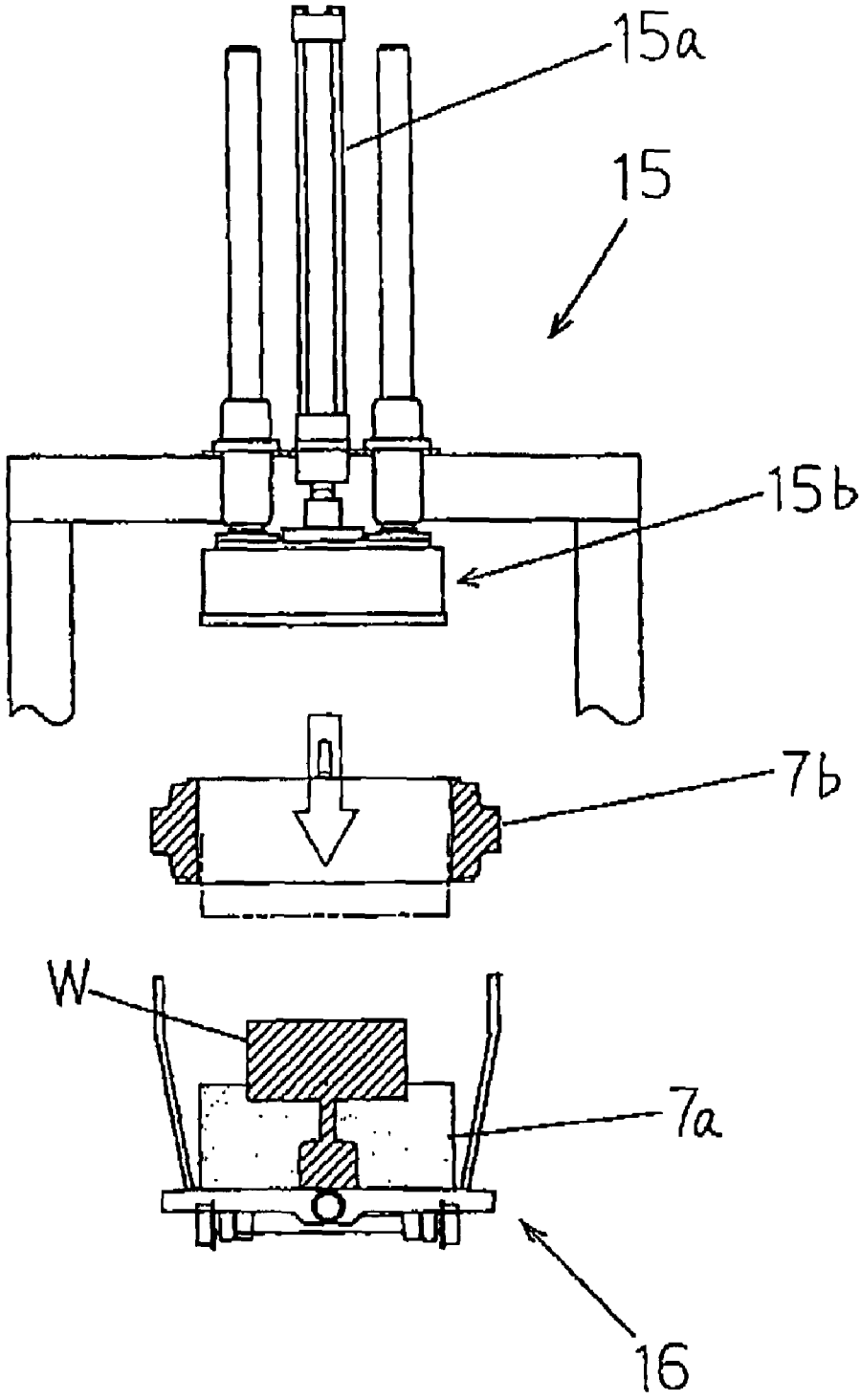
FIG. 11 is a cross-sectional side view of the second embodiment that uses a mold-drawing means.

The separated tight-flask drag 6 is then transferred for the following process (not shown), and the drag 6*a* is drawn during the process. Further, the tight-flask cope 7 and the as-cast product W are transferred by a known transfer means (not shown) to the position just below the mold-drawing means 15, as shown in FIG. 11. This mold-drawing means 15 is the same as the mold-drawing means 15 in the first embodiment. By extending the mold drawing cylinder 15*a*, the as-cast product W and the cope 7*a* are drawn downward from the flask 7*b* by the drawing head 15*b*. The same as in the first embodiment, the secondary cooling pallet-like trucks 16 as mold receiving means are sequentially transferred to the position below the a product W and the cope 7*a* to be drawn. The drawn as-cast product W and cope 7*a* are put in the secondary cooling pallet-like truck 16.

Further, as shown in FIG. 13, the group of the secondary cooling pallet-like trucks 16, each carrying the as-cast product W and the cope 7*a*, is transferred in the secondary cooling line 18 pitch by pitch. After the as-cast product W and the cope 7*a* are drawn, the empty cope 7*b* is transferred for the following process (not shown) after the drawing head 15*b* reaches its upper stop end by retracting the drawing cylinder 15*a*.

In the present invention, as explained above, a tight-flask cope 7 is placed on a tight-flask drag 6 for mating, with their gate U facing upward, and the tight-flask mold 8 (an assembly of the tight-flask cope 7 and the tight-flask drag 6), which has been poured with molten metal, is then reversed, so that the gate U faces downward. The assembly of the cope 7*a*, the drag 6*a*, and the as-cast product W, is then drawn from the reversed tight-flask mold 8, which holds the downwardly-facing gate U, from above to below. Alternatively, the tight-flask drag 6, which is positioned above after reversing, is separated from the tight-flask cope 7 in which the as-cast product W and the downwardly-facing gate U remain. The as-cast product W and the downwardly-facing gate U are then drawn from the flask 7*b*, from above to below. Accordingly, since the assembly of the as-cast product W and the downwardly-facing gate U, which is located below the product W, drops, the product W is not subjected to dents, thereby greatly reducing dents produced in the product.

Although the tight-flask molds 8 may be transferred on a roller conveyor, they are normally transferred on level trucks. When the tight-flask mold 8 is transferred on the level truck generally it is difficult to reverse the mold carried on the level truck and transfer it thereafter. However, in the present invention an upper level truck 10 is placed on the tight-flask mold 8 that has been poured with molten metal. This allows the mold to be easily transferred after it is reversed. Further, the lower level truck 9, which has been reversed and thus located on the tight-flask 6, is separated at the level-truck-separating station B and is then returned to the level-truck-mounting station A and used there as an upper-level-truck 10 to be placed on a tight-flask cope 7 of a tight-flask mold 8 that is transferred in the level-truck-mounting station A. Since the level trucks are circulated, changing from the upper-level-trucks 10 to the lower-level trucks 9 and vice versa, the number of the upper-level-trucks 10 to be used can be reduced, though they are necessary to be placed on the tight-flask molds 8.

Further, in the second embodiment the tight-flask drag 6, which has been reversed and thus located above, is separated from the reversed tight-flask mold 8 with the gate U facing downward, leaving the as-east product W in the tight-flask cope 7, which has been reversed and thus located below. The as-cast product W and the cope 7*a* are then drawn from the tight-flask cope 7, from above to below. This method produces advantages. The molding sand of the drag 6*a* drawn from the separated tight-flask drag 6 does not need to be transferred in the secondary cooling pallet-like truck 16, but it can be quickly returned to a sand processing line (not shown) for use for producing new molds. Thus the quantity of the sand to be used for the entire sand line can be reduced. Further, since as shown in FIG. 13 the as-cast product is transferred with a large part of it's surface exposed to the atmosphere, it can be more effectively cooled, reducing the time to secondarily cool it and shortening the secondary cooling line 18.

The invention claimed is:

1. A demolding method, comprising the steps of placing a tight-flask cope on a tight-flask drag for mating, such that a gate for the tight-flask cope and drag faces upward, and after the mated tight-flask cope and drag are poured with molten metal, transferring the mated tight-flask cope and drag placed on a lower level truck to a level-truck-mounting station; placing an upper level truck on the tight-flask cope and drag at the level-truck-mounting station such that the upper level truck faces the lower level truck; transferring the tight-flask cope and drag and the lower and upper level trucks from the level-truck-mounting station to a reversing station; reversing the tight-flask cope and drag and the upper and lower level trucks at the reversing station with the tight-flask cope and drag being sandwiched between the upper level truck and the lower level truck so that the upwardly facing gate faces downward; transferring the reversed tight-flask cope and drag and upper and lower level trucks from the reversing station to a level-truck-separating station; separating at the level-truck-separating station the lower level truck, which has been reversed and thus located above; returning the separated lower level truck to the level-truck-mounting station, and placing the returned lower level truck as an upper level truck on a tight-flask cope that is transferred together with a mated tight-flask drag to the level-truck-mounting station; separating the upper level truck from an assembly of the tight-flask cope and drag and the upper level truck, which assembly has been transferred from the level-truck-separating station; and downwardly drawing a cope, a drag, and an as-cast product, with the gate facing downward, from out of the tight-flask cope and drag, from above to below.

2. A demolding method, comprising the steps of placing a tight-flask cope on a tight-flask drag for mating, such that a gate for the tight-flask cope and drag faces upward, and after the mated tight-flask cope and drag are poured with molten metal, transferring the mated tight-flask cope and drag placed on a lower level truck to a level-truck-mounting station; placing an upper level truck on the tight-flask cope and drag at the level-truck-mounting station such that the upper level truck faces the lower level truck; transferring the tight-flask cope and drag and the lower and upper level trucks from the level-truck-mounting station to a reversing station; reversing the tight-flask cope and drag and the upper and lower level trucks at the reversing station with the tight-flask cope and drag being sandwiched between the upper level truck and the lower level truck so that the upwardly facing gate faces downward; transferring the reversed tight-flask cope and drag and upper and lower level trucks from the reversing station to a level-truck-separating station; separating at the level-truck-separating station the lower level truck, which has been reversed and thus located above; returning the separated lower level truck to the level-truck-mounting station, and placing the returned lower level truck as an upper level truck on a tight-flask cope that is transferred together with a mated tight-flask drag to the level-truck-mounting station; separating the upper level truck from an assembly of the tight-flask cope and drag and the upper level truck, which assembly has been transferred from the level-truck-separating station; separating the tight-flask drag, which is located above, from the tight-flask cope, which has been reversed and thus located under the tight-flask drag, allowing an as-cast product to remain in the tight-flask cope; and downwardly drawing a cope and the as-cast product from out of the tight-flask cope holding the as-cast product, from above to below.

3. A demolding equipment, comprising a level-truck-mounting means for placing an upper level truck on an opposing lower level truck on which a mated tight-flask cope and drag are carried, with a gate for the tight-flask cope and drag facing upward, the mated tight-flask cope and drag being poured with molten metal and being transferred to a level-truck-mounting station; a reversing means for reversing, at a reversing station disposed downstream of the level-truck-mounting station, the tight-flask cope and drag and the upper and lower level trucks, with the tight-flask cope and drag being sandwiched between the upper level truck and the lower level truck, such that the gate faces downward; a level-truck-separating means for separating at a level-truck-separating station disposed downstream of the reversing station the lower level truck, which has been reversed and thus is located on the tight-flask drag; a level-truck-transfer means for returning the separated lower level truck to the level-truck-mounting station; an upper-level-truck-separating means for separating the upper level truck from the tight-flask cope and the upper level truck, which has been transferred from the level-truck-separating station; and a mold-drawing means for downwardly drawing a cope, a drag, and as as-cast product from out of the tight-flask cope and drag, with the gate facing downward, from above to below.

4. A demolding equipment, comprising a level-truck-mounting means for placing an upper level truck on an opposing lower level truck on which a mated tight-flask cope and drag are carried, with a gate for the tight-flask cope and drag facing upward, the mated tight-flask cope and drag being poured with molten metal and being transferred to a level-truck-mounting station; a reversing means for reversing, at a reversing station disposed downstream of the level-truck-mounting station, the tight-flask cope and drag and the upper and lower level trucks, with the tight-flask cope and drag being sandwiched between the upper level truck and the lower level truck, such that the gate faces downward; a level-truck-separating means for separating at a level-truck-separating station disposed downstream of the reversing station the lower level truck, which has been reversed and thus is located on the tight-flask drag; a level-truck-transfer means for returning the separated lower level truck to the level-truck-mounting station; an upper-level-truck-separating means for separating the upper level truck from the tight-flask cope and the upper level truck, which has been transferred from the level-truck-separating station; a tight-flask-drag separating means for separating only the tight-flask drag, which is located above, from the tight-flask cope located under the tight-flask drag, allowing an as-cast product to remain in the tight-flask cope; and a mold-drawing means for downwardly drawing a cope and the as-cast product from out of the tight-flask cope, from above to below.

* * * * *